US009552783B2

(12) United States Patent
Kim

(10) Patent No.: US 9,552,783 B2
(45) Date of Patent: Jan. 24, 2017

(54) SOURCE DRIVER AND DISPLAY DEVICE HAVING THE SAME

(71) Applicant: SAMSUNG DISPLAY CO., LTD., Yongin, Gyeonggi-Do (KR)

(72) Inventor: Jin-Woo Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 148 days.

(21) Appl. No.: 14/522,546

(22) Filed: Oct. 23, 2014

(65) Prior Publication Data

US 2015/0243230 A1 Aug. 27, 2015

(30) Foreign Application Priority Data

Feb. 26, 2014 (KR) ..... 10-2014-0022524

(51) Int. Cl.
*G09G 3/36* (2006.01)

(52) U.S. Cl.
CPC ..... *G09G 3/3611* (2013.01); *G09G 2320/0276* (2013.01); *G09G 2320/0673* (2013.01)

(58) Field of Classification Search
CPC .. G09G 3/3611; G09G 3/3266; G09G 3/3674; G09G 2310/0267; G09G 2310/0286; G09G 2320/0276; G09G 2320/0673
See application file for complete search history.

(56) References Cited

U.S. PATENT DOCUMENTS

2010/0097365 A1* 4/2010 Fang ..... G09G 3/3648 345/212
2011/0032279 A1* 2/2011 Kim ..... G09G 3/2007 345/690
2012/0212474 A1 8/2012 Hwang et al.
2012/0256970 A1* 10/2012 Kim ..... G09G 3/2003 345/690
2012/0306893 A1 12/2012 Liu et al.

FOREIGN PATENT DOCUMENTS

KR 10-2008-0107064 A 12/2008
KR 10-2012-0094722 A 8/2012
KR 10-2013-0011173 A 1/2013

* cited by examiner

*Primary Examiner* — Premal Patel
(74) *Attorney, Agent, or Firm* — Lewis Roca Rothgerber Christie LLP

(57) ABSTRACT

A source driver includes: a gamma voltage generator configured to receive a plurality of gamma reference voltages, a first common pre-emphasis voltage, and a second common pre-emphasis voltage, and to generate a plurality of gamma voltages based on the gamma reference voltages, a plurality of first pre-emphasis pulses respectively corresponding to pixels that emit light of different colors based on the first common pre-emphasis voltage, and a plurality of second pre-emphasis pulses respectively corresponding to the pixels that emit the light of different colors based on the second common pre-emphasis voltage; and a voltage supply unit configured to output one of the first pre-emphasis pulses and the second pre-emphasis pulses to each of a plurality of data lines, and to output data voltages to the plurality of data lines based on the gamma voltages.

18 Claims, 8 Drawing Sheets

SOURCE DRIVER AND DISPLAY DEVICE HAVING THE SAME

CROSS REFERENCE TO RELATED APPLICATION

This application claims priority to and the benefit of Korean Patent Application No. 10-2014-0022524, filed on Feb. 26, 2014 in the Korean Intellectual Property Office (KIPO), the disclosure of which is hereby incorporated by reference herein in its entirety.

BACKGROUND

1. Field

Aspects of example embodiments relate to display devices. More particularly, example embodiments relate to a source driver connected to a gamma reference voltage generator and a display device having the same.

2. Discussion of Related Art

Generally, a method of supplying a pre-emphasis voltage (or a pre-emphasis pulse) is used to reduce driving delay time. Also, a gamma reference voltage generator (e.g., a gamma IC) is integrated on (or mounted on) a display device separate from a source driver to simplify a source driver system. Then, the pre-emphasis voltage is generated in the gamma reference voltage generator, and is inputted to the source driver.

In a display device having RGB pixels, the gamma reference voltage generator includes at least 6 channels (or lines) to provide a pre-emphasis voltage to the source driver. As the number of channels of the gamma reference voltage generator increases caused by supplying the pre-emphasis voltage, connecting cables and production cost may increase and the display device may become complicated.

SUMMARY

Aspects of example embodiments relate to a source driver having a gamma voltage generator which receives common pre-emphasis voltages.

Aspects of example embodiments relate to a display device including the source driver.

According to example embodiments, a source driver includes: a gamma voltage generator configured: to receive a plurality of gamma reference voltages, a first common pre-emphasis voltage, and a second common pre-emphasis voltage; and to generate a plurality of gamma voltages based on the gamma reference voltages, a plurality of first pre-emphasis pulses respectively corresponding to pixels that emit light of different colors based on the first common pre-emphasis voltage, and a plurality of second pre-emphasis pulses respectively corresponding to the pixels that emit the light of different colors based on the second common pre-emphasis voltage; and a voltage supply unit configured to output one of the first pre-emphasis pulses and the second pre-emphasis pulses to each of a plurality of data lines, and to output data voltages to the plurality of data lines based on the gamma voltages.

In example embodiments, the gamma voltage generator is configured to receive the first common pre-emphasis voltage through a first common pre-emphasis voltage supply channel, and to receive the second common pre-emphasis voltage through a second common pre-emphasis voltage supply channel.

In example embodiments, the plurality of gamma reference voltages include a plurality of red gamma reference voltages, a plurality of green gamma reference voltages, and a plurality of blue gamma reference voltages, and the plurality of gamma voltages include a plurality of red gamma voltages, a plurality of green gamma voltages, and a plurality of blue gamma voltages. The gamma voltage generator may include: a first resistor string configured to generate the red gamma voltages based on the red gamma reference voltages to determine at least one voltage level of a first one of the first pre-emphasis pulses corresponding to a red pixel based on the first common pre-emphasis voltage, and to determine at least one voltage level of a first one of the second pre-emphasis pulses corresponding to the red pixel based on the second common pre-emphasis voltage; a second resistor string configured to generate the green gamma voltages based on the green gamma reference voltages to determine at least one voltage level of a second one of the first pre-emphasis pulses corresponding to a green pixel based on the first common pre-emphasis voltage, and to determine at least one voltage level of a second one of second pre-emphasis pulses corresponding to the green pixel based on the second common pre-emphasis voltage; and a third resistor string configured to generate the blue gamma voltages based on the blue gamma reference voltages to determine at least one voltage level of a third one of the first pre-emphasis pulses corresponding to a blue pixel based on the first common pre-emphasis voltage, and to determine at least one voltage level of a third one of the second pre-emphasis pulses corresponding to the blue pixel based on the second common pre-emphasis voltage.

In example embodiments, the gamma voltage generator is further configured to adjust lengths of activation periods of the first pre-emphasis pulses based on a voltage difference between the first common pre-emphasis voltage and a highest one of the red gamma reference voltages, a voltage difference between the first common pre-emphasis voltage and a highest one of the green gamma reference voltages, and a voltage difference between the first common pre-emphasis voltage and a highest one of the blue gamma reference voltages. The gamma voltage generator may be further configured to adjust lengths of activation periods of the second pre-emphasis pulses based on a voltage difference between the second common pre-emphasis voltage and a lowest one of the red gamma reference voltages, a potential difference between the second common pre-emphasis voltage and a lowest one of the green gamma reference voltages, and a voltage difference between the second common pre-emphasis voltage and a lowest one of the blue gamma reference voltages.

In example embodiments, the gamma voltage generator further includes: a first red pre-emphasis pulse generator configured to adjust a length of a first activation period of the first one of the first pre-emphasis pulses based on a first voltage difference between the first common pre-emphasis voltage and a highest one of the red gamma reference voltages; a first green pre-emphasis pulse generator configured to adjust a length of a second activation period of the second one of the first pre-emphasis pulses based on a second voltage difference between the first common pre-emphasis voltage and a highest one of the green gamma reference voltages; and a first blue pre-emphasis pulse generator configured to adjust a length of a third activation period of the third one of the first pre-emphasis pulses based on a third voltage difference between the first common pre-emphasis voltage and a highest one of the blue gamma reference voltages.

In example embodiments, each of the first red pre-emphasis pulse generator, the first green pre-emphasis pulse generator, and the first blue pre-emphasis pulse generator includes: a charging capacitor; a charging transistor configured to charge the charging capacitor in response to an inversion signal of a gamma voltage output control signal; a voltage controlled current source configured to generate a discharge current based on a corresponding one of the first, second, and third voltage differences to discharge the charging capacitor; a comparator configured to compare a voltage of the charging capacitor with a reference voltage; and an AND gate configured to perform an AND operation on an output signal from the comparator and the gamma voltage output control signal to determine a corresponding one of the first, second, and third activation periods.

In example embodiments, the gamma voltage generator further includes: a second red pre-emphasis pulse generator configured to adjust a length of a fourth activation period of the first one of the second pre-emphasis pulses based on a fourth voltage difference between the second common pre-emphasis voltage and a lowest one of the red gamma reference voltages; a second green pre-emphasis pulse generator configured to adjust a length of a fifth activation period of the second one of the second pre-emphasis pulses based on a fifth voltage difference between the second common pre-emphasis voltage and a lowest one of the green gamma reference voltages; and a second blue pre-emphasis pulse generator configured to adjust a length of a sixth activation period of the third one of the second pre-emphasis pulses based on a sixth voltage difference between the second common pre-emphasis voltage and a lowest one of the blue gamma reference voltages.

In example embodiments, each of the second red pre-emphasis pulse generator, the second green pre-emphasis pulse generator, and the second blue pre-emphasis pulse generator includes: a charging capacitor; a charging transistor configured to charge the charging capacitor in response to an inversion signal of a gamma voltage output control signal; a voltage controlled current source configured to generate a discharge current based on a corresponding one of the fourth, fifth, and sixth voltage differences to discharge the charging capacitor; a comparator configured to compare a voltage of the charging capacitor with a reference voltage; and an AND gate configured to perform an AND operation on an output signal from the comparator and the gamma voltage output control signal to determine a corresponding one of the fourth, fifth, and sixth activation periods.

In example embodiments, the gamma voltage generator is further configured to adjust the voltage levels of the first pre-emphasis pulses based on a voltage difference between the first common pre-emphasis voltage and a highest one of the red gamma reference voltages, a voltage difference between the first common pre-emphasis voltage and a highest one of the green gamma reference voltages, and a voltage difference between the first common pre-emphasis voltage and a highest one of the blue gamma reference voltages. The gamma voltage generator may be further configured to adjust the voltage levels of the second pre-emphasis pulses based on a voltage difference between the second common pre-emphasis voltage and a lowest one of the red gamma reference voltages, a voltage difference between the second common pre-emphasis voltage and a lowest one of the green gamma reference voltages, and a voltage difference between the second common pre-emphasis voltage and a lowest one of the blue gamma reference voltages.

In example embodiments, the gamma voltage generator further includes: a first differential amplifier configured to adjust the voltage level of the first one of the first pre-emphasis pulses based on a voltage difference between the first common pre-emphasis voltage and a highest one of the red gamma reference voltages, the first differential amplifier being coupled to a first end of the first resistor string; a second differential amplifier configured to adjust the voltage level of the second one of the first pre-emphasis pulses based on a voltage difference between the first common pre-emphasis voltage and a highest one of the green gamma reference voltages, the second differential amplifier being coupled to a first end of the second resistor string; and a third differential amplifier configured to adjust the voltage level of the third one of the first pre-emphasis pulses based on a voltage difference between the first common pre-emphasis voltage and a highest one of the blue gamma reference voltages, the third differential amplifier being coupled to a first end of the third resistor string.

In example embodiments, the gamma voltage generator further includes: a fourth differential amplifier configured to adjust the voltage level of the first one of the second pre-emphasis pulses based on a voltage difference between the second common pre-emphasis voltage and a lowest one of the red gamma reference voltages, the fourth differential amplifier being coupled to a second end of the first resistor string; a fifth differential amplifier configured to adjust the voltage level of the second one of the second pre-emphasis pulses based on a voltage difference between the second common pre-emphasis voltage and a lowest one of the green gamma reference voltages, the fifth differential amplifier being coupled to a second end of the second resistor string; and a sixth differential amplifier configured to adjust the voltage level of the third one of the second pre-emphasis pulses based on a voltage difference between the second common pre-emphasis voltage and a lowest one of the blue gamma reference voltages, the sixth differential amplifier being coupled to a second end of the third resistor string.

In example embodiments, the second common pre-emphasis voltage is a ground voltage.

According to example embodiments, a display device comprises: a display panel; a gate driver configured to provide a gate signal to the display panel; a gamma reference voltage generator configured to generate a plurality of gamma reference voltages, a first common pre-emphasis voltage higher than a highest one of the gamma reference voltages, and a second common pre-emphasis voltage lower than a lowest one of the gamma reference voltages; and a source driver configured to provide a data voltage to the display panel the source driver including: a gamma voltage generator configured: to receive the gamma reference voltages, the first common pre-emphasis voltage, and the second common pre-emphasis voltage; and to generate a plurality of gamma voltages based on the gamma reference voltages, a plurality of first pre-emphasis pulses respectively corresponding to pixels that emit light of different colors based on the first common pre-emphasis voltage, and a plurality of second pre-emphasis pulses respectively corresponding to the pixels that emit the light of different colors based on the second common pre-emphasis voltage; and a voltage supply unit configured to output one of the first pre-emphasis pulses and the second pre-emphasis pulses to each of a plurality of data lines, and to output data voltages to the plurality of data lines based on the gamma voltages.

In example embodiments, the source driver is further configured to receive the first common pre-emphasis voltage from the gamma reference voltage generator through a first common pre-emphasis voltage supply channel, and the second common pre-emphasis voltage from the gamma reference voltage generator through a second common pre-emphasis voltage supply channel.

In example embodiments, the plurality of gamma reference voltages include a plurality of red gamma reference voltages, a plurality of green gamma reference voltages, and a plurality of blue gamma reference voltages, and the plurality of gamma voltages include a plurality of red gamma voltages, a plurality of green gamma voltages, and a plurality of blue gamma voltages. The gamma voltage generator may comprise: a first resistor string configured to generate the red gamma voltages based on the red gamma reference voltages to determine at least one voltage level of a first one of the first pre-emphasis pulses corresponding to a red pixel based on the first common pre-emphasis voltage, and to determine at least one voltage level of a first one of the second pre-emphasis pulses corresponding to the red pixel based on the second common pre-emphasis voltage; a second resistor string configured to generate the green gamma voltages based on the green gamma reference voltages to determine at least one voltage level of a second one of the first pre-emphasis pulses corresponding to a green pixel based on the first common pre-emphasis voltage, and to determine at least one voltage level of a second one of second pre-emphasis pulses corresponding to the green pixel based on the second common pre-emphasis voltage; and a third resistor string configured to generate the blue gamma voltages based on the blue gamma reference voltages to determine at least one voltage level of a third one of the first pre-emphasis pulses corresponding to a blue pixel based on the first common pre-emphasis voltage, and to determine at least one voltage level of a third one of the second pre-emphasis pulses corresponding to the blue pixel based on the second common pre-emphasis voltage.

In example embodiments, the gamma voltage generator is further configured to adjust lengths of activation periods of the first pre-emphasis pulses based on a voltage difference between the first common pre-emphasis voltage and a highest one of the red gamma reference voltages, a voltage difference between the first common pre-emphasis voltage and a highest one of the green gamma reference voltages, and a voltage difference between the first common pre-emphasis voltage and a highest one of the blue gamma reference voltages. The gamma voltage generator may be further configured to adjust lengths of activation periods of the second pre-emphasis pulses based on a voltage difference between the second common pre-emphasis voltage and a lowest one of the red gamma reference voltages, a potential difference between the second common pre-emphasis voltage and a lowest one of the green gamma reference voltages, and a voltage difference between the second common pre-emphasis voltage and a lowest one of the blue gamma reference voltages.

In example embodiments, the gamma voltage generator further includes: a first red pre-emphasis pulse generator configured to adjust a length of a first activation period of the first one of the first pre-emphasis pulses based on a first voltage difference between the first common pre-emphasis voltage and a highest one of the red gamma reference voltages; a first green pre-emphasis pulse generator configured to adjust a length of a second activation period of the second one of the first pre-emphasis pulses based on a second voltage difference between the first common pre-emphasis voltage and a highest one of the green gamma reference voltages; and a first blue pre-emphasis pulse generator configured to adjust a length of a third activation period of the third one of the first pre-emphasis pulses based on a third voltage difference between the first common pre-emphasis voltage and a highest one of the blue gamma reference voltages.

In example embodiments, each of the first red pre-emphasis pulse generator, the first green pre-emphasis pulse generator, and the first blue pre-emphasis pulse generator includes: a charging capacitor; a charging transistor configured to charge the charging capacitor in response to an inversion signal of a gamma voltage output control signal; a voltage controlled current source configured to generate a discharge current based on a corresponding one of the first, second, and third voltage differences to discharge the charging capacitor; a comparator configured to compare a voltage of the charging capacitor with a reference voltage; and an AND gate configured to perform an AND operation on an output signal from the comparator and the gamma voltage output control signal to determine a corresponding one of the first, second, and third activation periods.

In example embodiments, the gamma voltage generator further includes: a second red pre-emphasis pulse generator configured to adjust a length of a fourth activation period of the first one of the second pre-emphasis pulses based on a fourth voltage difference between the second common pre-emphasis voltage and a lowest one of the red gamma reference voltages; a second green pre-emphasis pulse generator configured to adjust a length of a fifth activation period of the second one of the second pre-emphasis pulses based on a fifth voltage difference between the second common pre-emphasis voltage and a lowest one of the green gamma reference voltages; and a second blue pre-emphasis pulse generator configured to adjust a length of a sixth activation period of the third one of the second pre-emphasis pulses based on a sixth voltage difference between the second common pre-emphasis voltage and a lowest one of the blue gamma reference voltages.

In example embodiments, each of the second red pre-emphasis pulse generator, the second green pre-emphasis pulse generator, and the second blue pre-emphasis pulse generator includes: a charging capacitor; a charging transistor configured to charge the charging capacitor in response to an inversion signal of a gamma voltage output control signal; a voltage controlled current source configured to generate a discharge current based on a corresponding one of the fourth, fifth, and sixth voltage differences to discharge the charging capacitor, a comparator configured to compare a voltage of the charging capacitor with a reference voltage; and an AND gate configured to perform an AND operation on an output signal from the comparator and the gamma voltage output control signal to determine a corresponding one of the fourth, fifth, and sixth activation periods.

Therefore, the source driver according to example embodiments may receive the first and second common pre-emphasis voltages from the gamma reference voltage generator through the first and second common pre-emphasis voltage supply channels, so that the number of the pre-emphasis voltage supply channels may decrease. Thus, production cost may be reduced, and connectors and connecting cables coupled between the gamma reference voltage generator and the source driver may be simplified.

In addition, the display device according to example embodiments may include the source driver and the gamma reference voltage generator, so that the number of the pre-emphasis voltage supply channels may decrease, and area of drivers may decrease.

BRIEF DESCRIPTION OF THE DRAWINGS

Example embodiments can be understood in more detail from the following description taken in conjunction with the accompanying drawings, in which.

DETAILED DESCRIPTION

Aspects of example embodiments will be described more fully hereinafter with reference to the accompanying drawings, in which various embodiments are shown.

Figure 1:
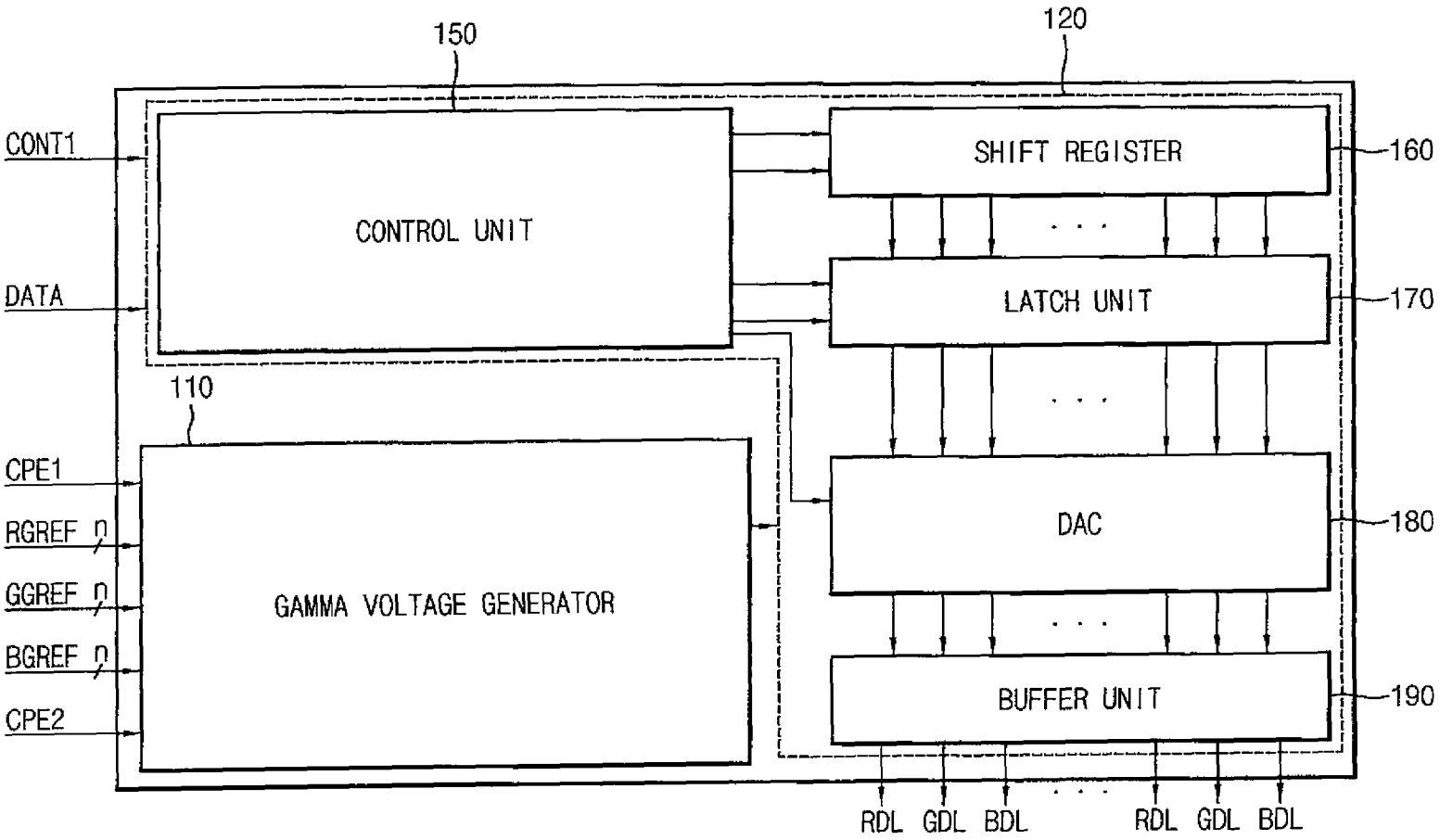
FIG. 1 is a block diagram illustrating a source driver according to example embodiments.
Figure 2:
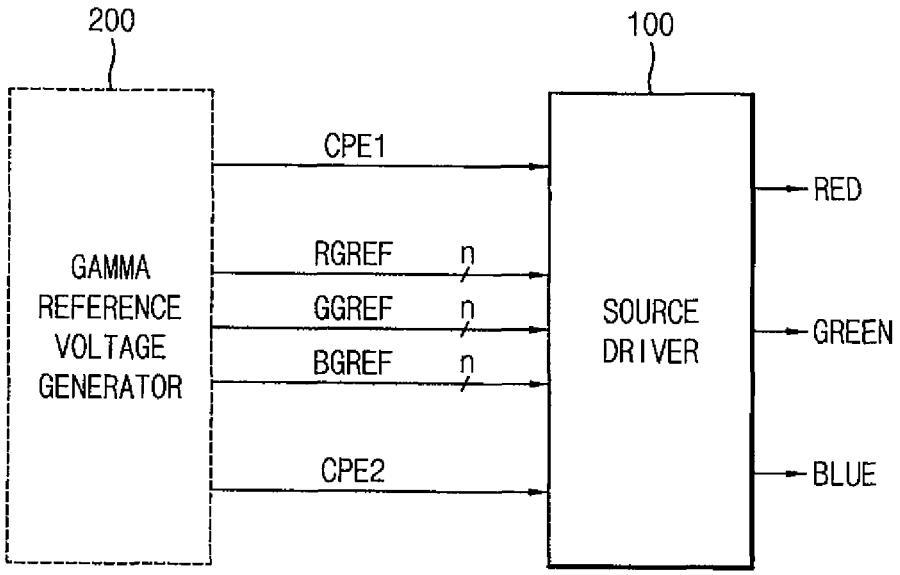
FIG. 2 is a block diagram illustrating an example of gamma reference voltage channels coupled to the source driver of FIG. 1.

FIG. 1 is a block diagram illustrating a source driver according to example embodiments, and FIG. 2 is a block diagram illustrating an example of gamma reference voltage channels coupled to the source driver of FIG. 1.

Referring to FIGS. 1 and 2, the source driver 100 may include a gamma voltage generator 110 and a voltage supply unit 120. The voltage supply unit 120 may include a control unit 150, a shift register 160, a latch unit 170, a digital analog converter (DAC) 180, and an output buffer unit 190.

The gamma voltage generator 110 may be configured to receive a plurality of gamma reference voltages (e.g., RGREF, GGREF, and BGREF) generated from a gamma reference voltage generator 200, and to generate a plurality of gamma voltages based on the gamma reference voltages. Further, the gamma voltage generator 110 may be configured to receive a first common pre-emphasis voltage CPE1 and a second common pre-emphasis voltage CPE2. The gamma voltage generator 110 may be configured to generate a plurality of first pre-emphasis pulses respectively corresponding to pixels that emit light of different colors based on the first common pre-emphasis voltage CPE1, and to generate a plurality of second pre-emphasis pulses respectively corresponding to the pixels that emit the light of different colors based on the second common pre-emphasis voltage CPE2.

In example embodiments, the gamma reference voltage generator 200 may be configured to respectively generate n numbers of red gamma reference voltages RGREF, n numbers of green gamma reference voltages GGREF, and n numbers of blue gamma reference voltages BGREF. The n numbers of red, green, and blue gamma reference voltages RGREF, GGREF, and BGREF may be inputted to the gamma voltage generator 110 through n channels, respectively (n is an integer greater than or equal to 2). The gamma reference voltage generator 200 is configured to generate the first common pre-emphasis voltage CPE1 higher than a highest one of the gamma reference voltages RGREF, GGREF, and BGREF, and to generate the second common pre-emphasis voltage CPE2 lower than a lowest one of the gamma reference voltages RGREF, GGREF, and BGREF. The first common pre-emphasis voltage CPE1 may be inputted to the gamma voltage generator 110 through a first common pre-emphasis voltage supply channel, and the second common pre-emphasis voltage CPE2 may be inputted to the gamma voltage generator 110 through a second common pre-emphasis voltage supply channel.

In example embodiments, the gamma voltage generator 110 may include a first resistor string, a second resistor string, and a third resistor string. The first resistor string may be configured to generate a plurality of red gamma voltages based on a first to an nth red gamma reference voltages, to determine at least one voltage level of a first one of the first pre-emphasis pulses (e.g., a first red pre-emphasis pulse) corresponding to a red pixel based on the first common pre-emphasis voltage CPE1, and to determine at least one voltage level of a first one of the second pre-emphasis pulses (e.g., a second red pre-emphasis pulse) corresponding to the red pixel based on the second common pre-emphasis voltage CPE2. The second resistor string may be configured to generate a plurality of green gamma voltages based on a first to an nth green gamma reference voltages, to determine at least one voltage level of a second one of the first pre-emphasis pulses (e.g., a first green pre-emphasis pulse) corresponding to a green pixel based on the first common pre-emphasis voltage CPE1, and to determine at least one voltage level of a second one of the second pre-emphasis pulses (e.g., a second green pre-emphasis pulse) corresponding to the green pixel based on the second common pre-emphasis voltage CPE2. The third string may be configured to generate a plurality of blue gamma voltages based on a first to an nth blue gamma reference voltages, to determine at least one voltage level of a third one of the first pre-emphasis pulses (e.g., a first blue pre-emphasis pulse) corresponding to a blue pixel based on the first common pre-emphasis voltage CPE1, and to determine at least one voltage level of a third one of the second pre-emphasis pulses (e.g., a second blue pre-emphasis pulse) corresponding to the blue pixel based on the second common pre-emphasis voltage CPE2. For example, the gamma voltage generator 110 may receive a first to an eighth red gamma reference voltages through eight channels, and the first string of the gamma voltage generator 110 may generate 256 red gamma voltages by dividing the first to eighth gamma reference voltages. Also, the gamma voltage generator 110 may receive the first pre-emphasis voltage through one channel, and the first string may generate 64 red pre-emphasis voltage levels by dividing the first pre-emphasis voltage. Here, all of the red pre-emphasis voltage levels may be higher than a highest one of the red gamma voltages. However, the number of gamma reference voltages, the number of channels, etc. are not limited thereto.

In example embodiments, the highest gamma reference voltage may correspond to a first blue gamma reference voltage, and the lowest gamma reference voltage may correspond to an nth blue gamma reference voltage. Thus, the first common pre-emphasis voltage CPE1 may be higher than the first blue gamma reference voltage, and the second common pre-emphasis voltage CPE2 may be lower than the nth blue gamma reference voltage. First gamma reference voltages (e.g., the first red gamma reference voltage, the first green gamma reference voltage, and the first blue gamma reference voltage) may be the highest gamma reference voltages in each of the pixels (e.g., the red pixel, the green pixel, and the blue pixel). The nth gamma reference voltages (e.g., the nth red gamma reference voltage, the nth green gamma reference voltage, and the nth blue gamma reference voltage) may be the lowest gamma reference voltages in each of the pixels (e.g., the red pixel, the green pixel, and the blue pixel).

The voltage supply unit 120 may be configured to output one of the first pre-emphasis pulses and the second pre-emphasis pulses to each of a plurality of data lines RDL, GDL, and BDL, and to output data voltages to the plurality of data lines RDL, GDL, and BDL based on the gamma voltages.

In example embodiments, the voltage supply unit 120 may include the control unit 150, the shift register 160, the latch unit 170, the DAC 180, and the output buffer unit 190.

The control unit 150 may receive a first control signal CONT1 and an input data DATA, and may control the source driver. The first control signal CONT1 may be generated from a timing control unit.

The shift register 160 may output a latch pulse to a plurality of latches in the latch unit 170.

The latch unit 170 may sequentially store the input data DATA according to the latch pulse from the shift register 160, and may output the stored input data DATA to the DAC 180.

The DAC 180 may select red, green, and blue data voltages (e.g., digital data) corresponding to the input data DATA from the red, green, and blue gamma voltages, and may output the red, green, and blue data voltages (e.g., analog data) to the output buffer unit 190.

The output buffer unit 190 may output the red, green, and blue data voltages from the DAC 180 to the red, green, and blue data lines RDL, GDL and BDL, respectively.

The red, green, and blue gamma voltages may have different voltage ranges that are defined by combinations of high levels and low levels, respectively. Generally, the voltage range of the red gamma voltage may be greater than the voltage range of the green gamma voltage, and the voltage range of the green gamma voltage may be greater than the voltage range of the blue gamma voltage. Thus, when the first common pre-emphasis voltage CPE1 higher than the highest gamma reference voltage (e.g., higher than the first blue gamma reference voltage), and the second common pre-emphasis voltage CPE2 lower than the lowest gamma reference voltage (e.g., lower than the nth blue gamma reference voltage) are commonly provided to generate the data voltages, voltage overshoot/undershoot and ringing may be unexpectedly produced in the red and green data voltages having relatively small data ranges. Therefore, the activation periods of the pre-emphasis pulses based on the first and second common pre-emphasis voltages CPE1 and CPE2 may be adjusted to prevent or substantially prevent the voltage overshoot/undershoot and ringing. On the other hand, voltage levels of the first and second pre-emphasis voltages CPE1 and CPE2 provided to the gamma voltage generator 110 may be adjusted depending on the voltage ranges of the red, green, and blue gamma voltages to prevent or substantially prevent the gamma voltages overshoot/undershoot and ringing. In other words, the first pre-emphasis voltages CPE1 may be adjusted depending on respective ones of the first red, green, and blue gamma voltages, and the second pre-emphasis voltages CPE2 may be adjusted depending on respective ones of the nth red, nth green, and nth blue gamma voltages.

In example embodiments, the gamma voltage generator 110 may adjust lengths of activation periods of the first pre-emphasis pulses based on a voltage difference between the first common pre-emphasis voltage CPE1 and the first red gamma reference voltage (e.g., a highest one of the red gamma reference voltages RGREF), a voltage difference between the first common pre-emphasis voltage CPE1 and the first green gamma reference voltage (e.g., a highest one of the green gamma reference voltages GGREF), and a voltage difference between the first common pre-emphasis voltage CPE1 and the first blue gamma reference voltage (e.g., a highest one of the blue gamma reference voltages BGREF). Also, the gamma voltage generator 110 may adjust lengths of activation periods of the second pre-emphasis pulses based on a voltage difference between the second common pre-emphasis voltage CPE2 and the nth red gamma reference voltage (e.g., a lowest one of the red gamma reference voltages RGREF), a voltage difference between the second common pre-emphasis voltage CPE2 and the nth green gamma reference voltage (e.g., a lowest one of the green gamma reference voltages GGREF), and a voltage difference between the second common pre-emphasis voltage CPE2 and the nth blue gamma reference voltage (e.g., a lowest one of the blue gamma reference voltages BGREF).

In example embodiments, the first pre-emphasis pulse may include the first red, green, and blue pre-emphasis pulses respectively corresponding to the red, green, and blue pixels. The second pre-emphasis pulse may include the second red, green, and blue pre-emphasis pulses respectively corresponding to the red, green, and blue pixels.

The gamma voltage generator 110 may further include a first red pre-emphasis pulse generator, a first green pre-emphasis pulse generator, and a first blue pre-emphasis pulse generator. In example embodiments, the first red pre-emphasis pulse generator may be configured to adjust a length of a first activation period of the first one of the first pre-emphasis pulses (e.g., a length of a first activation period of a first red pre-emphasis pulse) based on a first voltage difference between the first common pre-emphasis voltage CPE1 and the first red gamma reference voltage. In example embodiments, the first green pre-emphasis pulse generator may be configured to adjust a length of a second activation period of the second one of the first pre-emphasis pulses (e.g., a length of a second activation period of a first green pre-emphasis pulse) based on a second voltage difference between the first common pre-emphasis voltage CPE1 and the first green gamma reference voltage. In example embodiments, the first blue pre-emphasis pulse generator may be configured to adjust a length of a third activation period of the third one of the first pre-emphasis pulses (e.g., a length of a third activation period of a first blue pre-emphasis pulse) based on a third voltage difference between the first common pre-emphasis voltage CPE1 and the first blue gamma reference voltage.

The first red gamma reference voltage may be lower than the first green gamma reference voltage, and the first green gamma reference voltage may be lower than the first blue gamma reference voltage. Thus, the first voltage difference may be the largest among the first to third voltage differences. As a result, the length of the first activation period may be the shortest among the first to third activation periods to prevent or substantially prevent the red gamma voltage from overshooting. Similarly, the length of the second activation period may be shorter than the length of the third activation period.

In example embodiments, the first red pre-emphasis pulse generator may include a charging capacitor, a charging transistor configured to charge the charging capacitor in response to an inversion signal of a gamma voltage output control signal, a voltage controlled current source configured to discharge the charging capacitor by generating a discharge current based on the first voltage difference, a comparator configured to compare a voltage of the charging capacitor with a reference voltage, and an AND gate configured to perform an AND operation on an output signal from the comparator and the gamma voltage output control signal to determine the first activation period.

The first green pre-emphasis pulse generator and the first blue pre-emphasis pulse generator may have substantially the same constitution as that of the first red pre-emphasis pulse generator, so that the first green and first blue pre-emphasis pulse generators may respectively determine (or adjust) the second and third activation periods to prevent or substantially prevent the green and blue gamma voltages from overshooting, respectively.

In example embodiments, the pre-emphasis pulse (including the red, green, and blue pre-emphasis pulses) may be determined according to the pre-emphasis voltage level and the length of the activation period. The pre-emphasis voltage level may be determined by a voltage difference between a current (e.g., present) output data voltage and a previous output data voltage immediately preceding the current output data voltage. For example, the first red pre-emphasis pulse may be determined by the first activation period that is determined by the first voltage difference, and the first red pre-emphasis voltage level that is determined by the voltage difference between a current output red data voltage and a previous output red data voltage immediately preceding the current output red data voltage.

In example embodiments, the pre-emphasis pulse generators may generate pre-emphasis pulses by determining voltage levels of the pre-emphasis pulses and lengths of activation periods. The voltage level of the pre-emphasis pulse may be determined by a voltage difference between a current (e.g., present) output data voltage and a previous output data voltage immediately preceding the current output data voltage.

The first voltage difference (or, the second and third voltage differences) may be outputted from an amplifier (e.g., a subtractor). The voltage controlled current source may control the discharge current by using the first voltage difference. The greater the first voltage difference (or, the second and third voltage differences) is, the larger the discharge current may be generated by the voltage controlled current source. Thus, the charging capacitor may be rapidly discharged, so that the first activation period (or, the second and third activation periods) may become shorter. On the other hand, the smaller the first voltage difference (or, the second and third voltage differences) is, the smaller the discharge current may be generated by the voltage controlled current source. Thus, the charging capacitor may be slowly discharged, so that the first activation period (or, the second and third activation periods) may become longer. As a result, the lengths of the first, second, and third activation periods may be different from each other.

The gamma voltage generator 110 may further include a second red pre-emphasis pulse generator, a second green pre-emphasis pulse generator, and a second blue pre-emphasis pulse generator. In example embodiments, the second red pre-emphasis pulse generator may be configured to adjust a length of a fourth activation period of the first one of the second pre-emphasis pulses (e.g., a length of a fourth activation period of a second red pre-emphasis pulse) based on a fourth voltage difference between the second common pre-emphasis voltage CPE2 and the nth red gamma reference voltage. In example embodiments, the second green pre-emphasis pulse generator may be configured to adjust a length of a fifth activation period of the second one of the second pre-emphasis pulses (e.g., a length of a fifth activation period of a second green pre-emphasis pulse) based on a fifth voltage difference between the second common pre-emphasis voltage CPE2 and the nth green gamma reference voltage. In example embodiments, the second blue pre-emphasis pulse generator may be configured to adjust a length of a sixth activation period of the third one of the second pre-emphasis pulses (e.g., a length of a sixth activation period of a second blue pre-emphasis pulse) based on a sixth voltage difference between the second common pre-emphasis voltage CPE2 and the nth blue gamma reference voltage.

In example embodiments, the second red pre-emphasis pulse generator may include a charging capacitor, a charging transistor configured to charge the charging capacitor in response to an inversion signal of a gamma voltage output control signal, a voltage controlled current source configured to discharge the charging capacitor by generating a discharge current based on the fourth voltage difference, a comparator configured to compare a voltage of the charging capacitor with a reference voltage, and an AND gate configured to perform an AND operation on an output signal from the comparator and the gamma voltage output control signal to determine the fourth activation period.

The second green pre-emphasis pulse generator and the second blue pre-emphasis pulse generator may have substantially the same constitution as that of the second red pre-emphasis pulse generator, so that the second green and second blue pre-emphasis pulse generators may respectively determine (or adjust) the fifth and sixth activation periods to prevent or substantially prevent the green and blue gamma voltages from undershooting, respectively.

The greater the fourth voltage difference (or, the fifth and sixth voltage differences) is, the larger the discharge current may be generated by the voltage controlled current source. Thus, the charging capacitor may be rapidly discharged, so that the fourth activation period (or, the fifth and sixth activation periods) may become shorter. On the other hand, the smaller the fourth voltage difference (or, the fifth and sixth voltage differences) is, the smaller the discharge current may be generated by the voltage controlled current source. Thus, the charging capacitor may be slowly discharged, so that the fourth activation period (or, the fifth and sixth activation periods) may become longer. As a result, the lengths of the fourth, fifth, and sixth activation periods may be different from each other.

In example embodiments, the gamma voltage generator 110 may include a first differential amplifier coupled to a first end of the first resistor string, a second differential amplifier coupled to a first end of the second resistor string, and a third differential amplifier coupled to a first end of the third resistor string. The first differential amplifier may be configured to adjust the voltage level of the first one of the first pre-emphasis pulses based on a voltage difference between the first common pre-emphasis voltage CPE1 and the first red gamma reference voltage (e.g., the first voltage difference). The second differential amplifier may be configured to adjust the voltage level of the second one of the first pre-emphasis pulses based on a voltage difference between the first common pre-emphasis voltage CPE1 and the first green gamma reference voltage (e.g., the second voltage difference). The third differential amplifier may be configured to adjust the voltage level of the third one of the first pre-emphasis pulses based on a voltage difference between the first common pre-emphasis voltage CPE1 and the first blue gamma reference voltage (e.g., the third voltage difference).

Thus, the first to third differential amplifier may adjust the voltage levels of the first red, first green, and first blue pre-emphasis pulses to have the voltage levels lower than the first common pre-emphasis voltage CPE1 to prevent or substantially prevent the red, green, and blue gamma voltages from overshooting. For example, the highest voltage level of the first red pre-emphasis pulse may be adjusted to lower than the first common pre-emphasis voltage CPE1. Thus, overshoots at the red data voltage caused by the first common pre-emphasis voltage CPE1 may be prevented or substantially prevented.

In example embodiments, the gamma voltage generator 110 may further include a fourth differential amplifier coupled to a second end of the first resistor string, a fifth differential amplifier coupled to a second end of the second resistor string, and a sixth differential amplifier coupled to a second end of the third resistor string. The fourth differential amplifier may be configured to adjust the voltage level of the first one of the second pre-emphasis pulses based on a voltage difference between the second common pre-emphasis voltage CPE2 and the nth red gamma reference voltage (e.g., the fourth voltage difference). The fifth differential amplifier may be configured to adjust the voltage level of the second one of the second pre-emphasis pulses based on a voltage difference between the second common pre-emphasis voltage CPE2 and the nth green gamma reference voltage (e.g., the fifth voltage difference). The sixth differential amplifier may be configured to adjust the voltage level of the third one of the second pre-emphasis pulses based on a voltage difference between the second common pre-emphasis voltage CPE2 and the nth blue gamma reference voltage (e.g., the sixth voltage difference).

Thus, the fourth to sixth differential amplifier may adjust the voltage levels of the second red, second green, and second blue pre-emphasis pulses to have the voltage levels higher than the second common pre-emphasis voltage CPE2 to prevent or substantially prevent the red, green, and blue gamma voltages from undershooting. For example, the lowest voltage level of the second red pre-emphasis pulse may be adjusted to higher than the second common pre-emphasis voltage CPE2. Thus, undershooting at the red data voltage caused by the second common pre-emphasis voltage CPE2 may be prevented or substantially prevented.

The voltage levels of the pre-emphasis pulses outputted to each of the data lines (e.g., the voltage levels of the first red, second red, first green, second green, first blue, and second blue pre-emphasis pulses) may be different from each other. In this case, each of the activation periods of the pre-emphasis pulses (e.g., the first to sixth activation periods) may be substantially the same.

In example embodiments, the source driver 100 may output a pre-emphasis pulse having a voltage level that is determined by a voltage difference between a current (e.g., present) output data voltage and a previous output data voltage immediately preceding the current output data voltage.

In example embodiments, the second common pre-emphasis voltage CPE2 may be a ground voltage. Thus, the second common pre-emphasis voltage supply channel coupled between the gamma reference voltage generator 200 and the source driver 100 may be omitted.

As described above, the source driver in FIGS. 1 and 2 may receive the first and second common pre-emphasis voltages CPE1 and CPE2 from the gamma reference voltage generator 200 through the first and second common pre-emphasis voltage supply channels, so that the number of the pre-emphasis voltage supply channels may decrease. Thus, connectors and connecting cables coupled (e.g., connected) between the gamma reference voltage generator 200 and the source driver 100 may be simplified.

In addition, the gamma voltage generator 110 may include the pre-emphasis pulse generators or the differential amplifiers, so that overshooting and/or undershooting the data voltages (e.g., the red, green, and blue gamma voltages) may be prevented or substantially prevented.

Figure 3:
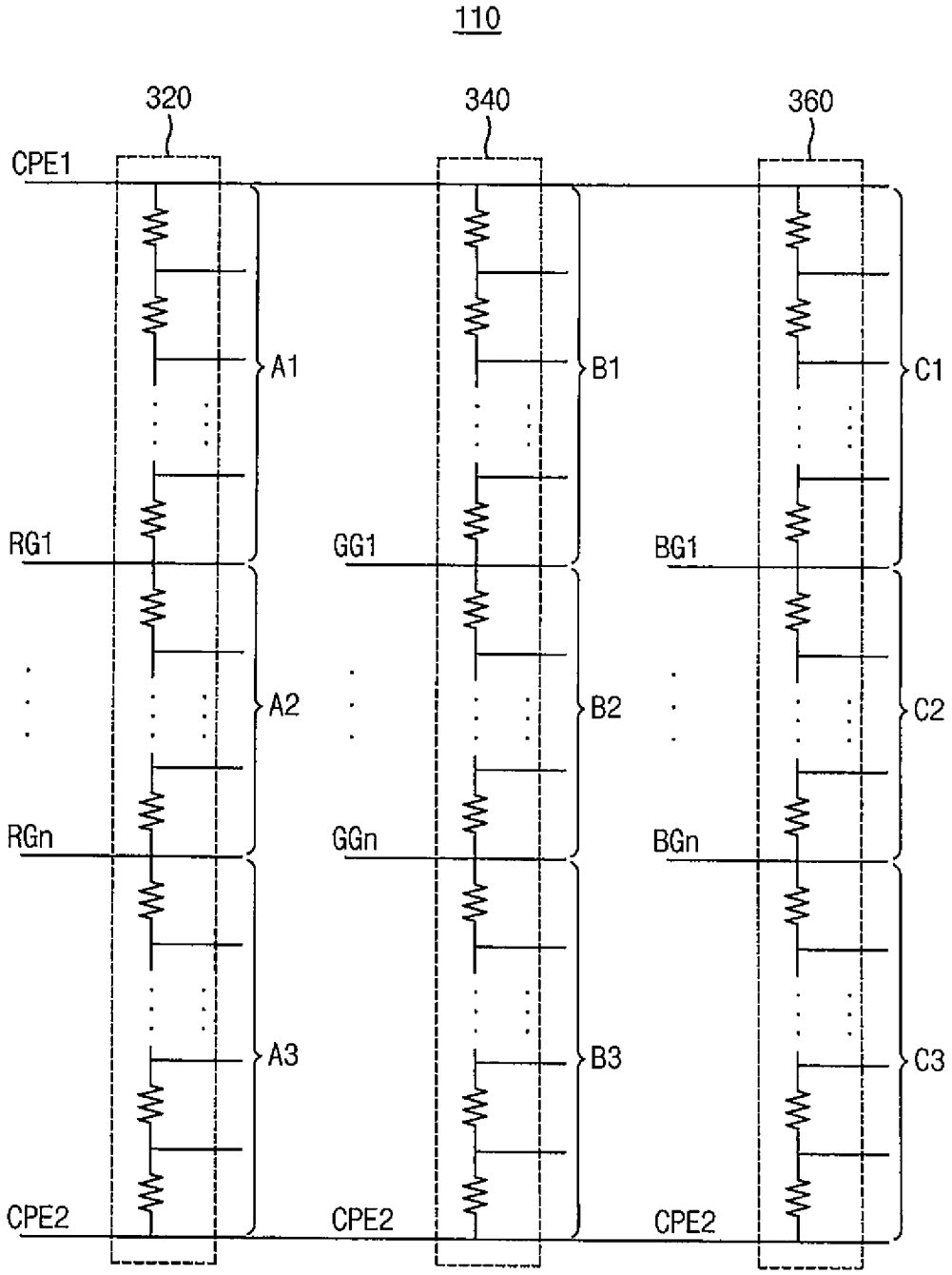
FIG. 3 is a diagram illustrating an example of a gamma voltage generator of the source driver of FIG. 1.

FIG. 3 is a diagram illustrating an example of a gamma voltage generator of the source driver of FIG. 1.

Referring to FIG. 3, the gamma voltage generator 110 may include a first resistor string 320, a second resistor string 340, and a third resistor string 360.

In example embodiments, the gamma voltage generator 110 may receive a first common pre-emphasis voltage CPE1 from a gamma reference voltage generator through a first common pre-emphasis voltage supply channel, and may receive a second common pre-emphasis voltage CPE2 from the gamma reference voltage generator through a second common pre-emphasis voltage channel.

In example embodiments, the first common pre-emphasis voltage CPE1 is higher than a highest one of the gamma reference voltages, and the second common pre-emphasis voltage CPE2 is lower than a lowest one of the gamma reference voltages.

The first resistor string 320 may receive a first red gamma reference voltage RG1 to an nth red gamma reference voltage RGn through n channels (or n lines), respectively. The first resistor string 320 may generate (or determine) a plurality of red gamma voltages A2 by dividing the first to nth red gamma reference voltages RG1 to RGn. Also, the first resistor string 320 may determine a plurality of voltage levels of a first red pre-emphasis pulse by dividing the first common pre-emphasis voltage CPE1, and may determine a plurality of voltage levels of a second red pre-emphasis pulse by dividing the second common pre-emphasis voltage CPE2. Similarly, the second and third resistor strings 340 and 360 may determine a plurality of green gamma voltages B2 and a plurality of blue gamma voltages C2 by dividing the first to nth green gamma reference voltages GG1 to GGn, and the first to nth blue gamma reference voltages BG1 to BGn, respectively. The second resistor string 340 may determine a plurality of voltage levels of a first green pre-emphasis pulse by dividing the first common pre-emphasis voltage CPE1, and may determine a plurality of voltage levels of a second green pre-emphasis pulse by dividing the second common pre-emphasis voltage CPE2. Also, the third resistor string 360 may determine a plurality of voltage levels of a first blue pre-emphasis pulse by dividing the first common pre-emphasis voltage CPE1, and may determine a plurality of voltage levels of a second blue pre-emphasis pulse by dividing the second common pre-emphasis voltage CPE2.

In example embodiments, the gamma voltage generator 110 is configured to output the first voltage difference A1 between the first common pre-emphasis voltage CPE1 and the first red gamma reference voltage RG1. The first voltage difference A1 may be inputted to the first red pre-emphasis pulse generator, and may be used to adjust the length of the first activation period. The fourth voltage difference A3 may be inputted to the second red pre-emphasis pulse generator, and may be used to adjust the length of the fourth activation period.

Similarly, the gamma voltage generator 110 may output the second voltage difference B1 between the first common pre-emphasis voltage CPE1 and the first green gamma reference voltage GG1, and may output the third voltage difference C1 between the first common pre-emphasis voltage CPE1 and the first blue gamma reference voltage BG1. Also, the gamma voltage generator 110 may output the fifth voltage difference B3 between the second common pre-emphasis voltage CPE2 and the nth green gamma reference voltage GGn, and may output the sixth voltage difference C3 between the second common pre-emphasis voltage CPE2 and the nth blue gamma reference voltage BGn.

In example embodiments, the gamma voltage generator 110 may respectively adjust the lengths of the activation periods of the first red, first green, and first blue pre-emphasis pulses based on the first to third voltage differences A1, B1, and C1 to prevent or substantially prevent the red, green, and blue gamma voltages from overshooting. In example embodiments, the gamma voltage generator 110 may respectively adjust the lengths of the activation periods of the second red, second green, and second blue pre-emphasis pulses based on the fourth to sixth voltage differences A3, B3, and C3 to prevent or substantially prevent the red, green, and blue gamma voltages from overshooting.

Figure 4A:
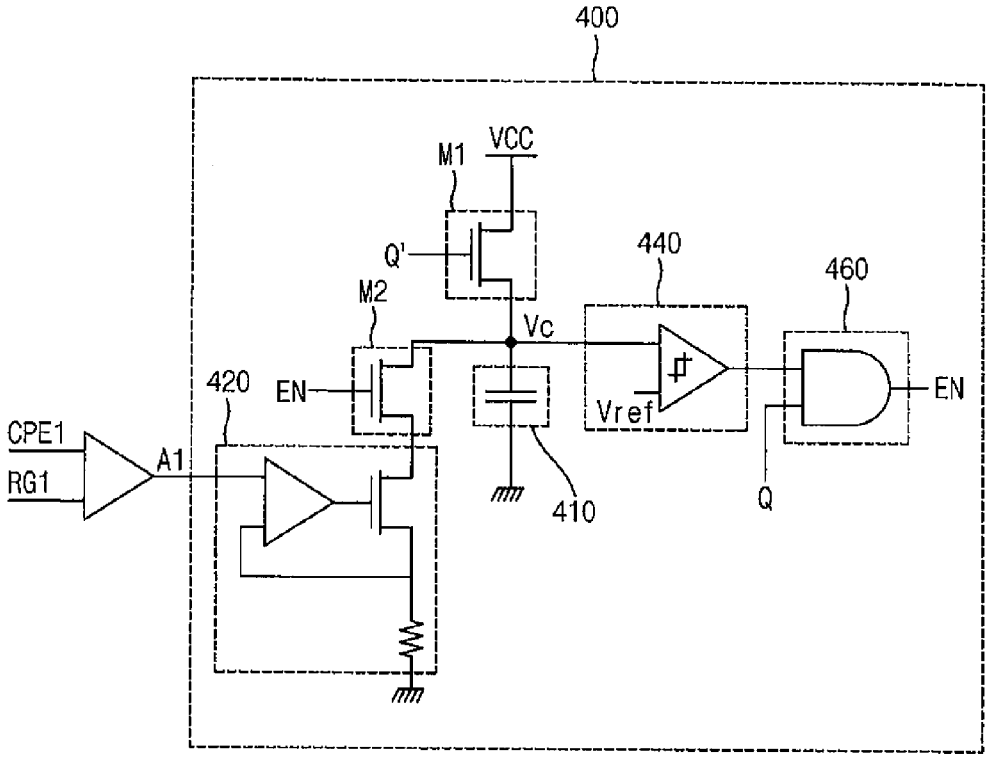
FIG. 4A is a diagram illustrating an example of a pre-emphasis pulse generator of the gamma voltage generator of FIG. 3.
Figure 4B:
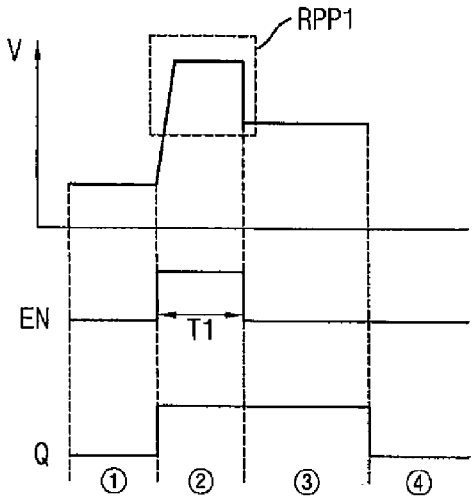
FIG. 4B is a timing diagram illustrating an example of an operation of the pre-emphasis pulse generator of FIG. 4A.

FIG. 4A is a diagram illustrating an example of a pre-emphasis pulse generator of the gamma voltage generator of FIG. 3, and FIG. 4B is a timing diagram illustrating an example of an operation of the pre-emphasis pulse generator of FIG. 4A.

For example, FIG. 4A is a diagram illustrating an example of a first red pre-emphasis pulse generator 400.

Referring to FIGS. 4A and 4B, in example embodiments, the first red pre-emphasis pulse generator 400 may adjust the first activation period T1 based on the first voltage difference A1 between the first common pre-emphasis voltage CPE1 and the first red gamma reference voltage RG1.

In example embodiments, the first red pre-emphasis pulse generator 400 may include a charging capacitor 410, a charging transistor M1 configured to charge the charging capacitor 410 in response to an inversion signal Q' of a gamma voltage output control signal, a voltage controlled current source 420 configured to discharge the charging capacitor 410 by generating a discharge current based on the first voltage difference A1, a comparator 440 configured to compare a voltage Vc of the charging capacitor 410 with a reference voltage Vref, and an AND gate 460 configured to perform an AND operation on an output signal from the comparator 440 and the gamma voltage output control signal Q to determine the first activation period T1. The AND gate 460 may output a first enable signal EN to determine the first activation period T1. The first activation period T1 may be maintained by the first enable signal EN which is at a high level.

As illustrated in FIGS. 4A and 4B, in a first period ①, the gamma voltage output control signal Q is at a low level, so that the inversion signal Q' of the gamma voltage output signal may be at a high level. Thus, the charging transistor M1 may be turned on by the inversion signal Q', and the charging capacitor 410 may be charged by receiving a voltage (e.g., a DC voltage) from a voltage source VCC. Here, the voltage Vc of the charging capacitor 410 inputted to the comparator 440 may be greater than the reference voltage Vref, so that an output signal from the comparator 440 may be at a high level. Then, the AND gate 460 may receive the high level signal of the comparator 440 and the low level the gamma voltage output control signal Q. The AND gate 460 may output the first enable signal EN having a low level. Here, an enable transistor M2 may be turned off.

In a second period ②, the inversion signal Q' may have a low level signal, so that the charging transistor M1 may be turned off. The second period ② may be the first activation period T1. The comparator 440 may output a high level signal while the voltage Vc of the charging capacitor 410 is higher than the reference voltage Vref. Thus, the AND gate 460 may output the first enable signal EN having a high level. The enable transistor M2 may be turned on by the high level first enable signal EN. Thus, while the enable transistor is turned on, the voltage controlled current source 420 may generate the discharge current based on the first voltage difference A1, and discharge the charging capacitor 410. Here, the first activation period T1 may correspond to a period that the first enable signal EN may be at the high level.

In a third period ③, the gamma voltage output control signal Q may still have the high level signal, and the voltage Vc of the charging capacitor 410 is lower than the reference voltage Vref by discharging the charging capacitor 410. At a moment when the voltage Vc of the charging capacitor 410 becomes lower than the reference voltage Vref, the comparator 440 may output a low level signal, and the first enable signal EN may be at a low level.

In a fourth period ④, the gamma voltage output control signal Q may be at the low level, so that the charging transistor M1 may be turned on and the charging capacitor 410 may be charged again by the voltage source VCC.

As a result, the first red pre-emphasis pulse generator 400 may determine the length of the first activation period T1 by the first enable signal EN. Further, in example embodiments, the first red pre-emphasis pulse RPP1 may have a voltage level that is determined by a voltage difference between a current (e.g., present) output red data voltage and a previous output red data voltage immediately preceding the current output red data voltage. The first green and first blue pre-emphasis pulse generators may respectively generate the first green and first blue pre-emphasis pulse using substantially the same process as the first red pre-emphasis pulse RPP1 being generated.

The second red, second green, and second blue pre-emphasis pulse generators may have substantially the same constitution as the first red pre-emphasis pulse generator 400. Thus, the second red, second green, and second blue pre-emphasis pulse generators may respectively generate the second red, second green, and second blue pre-emphasis pulse using substantially the same process as the first red pre-emphasis pulse RPP1 being generated.

Figure 4C:
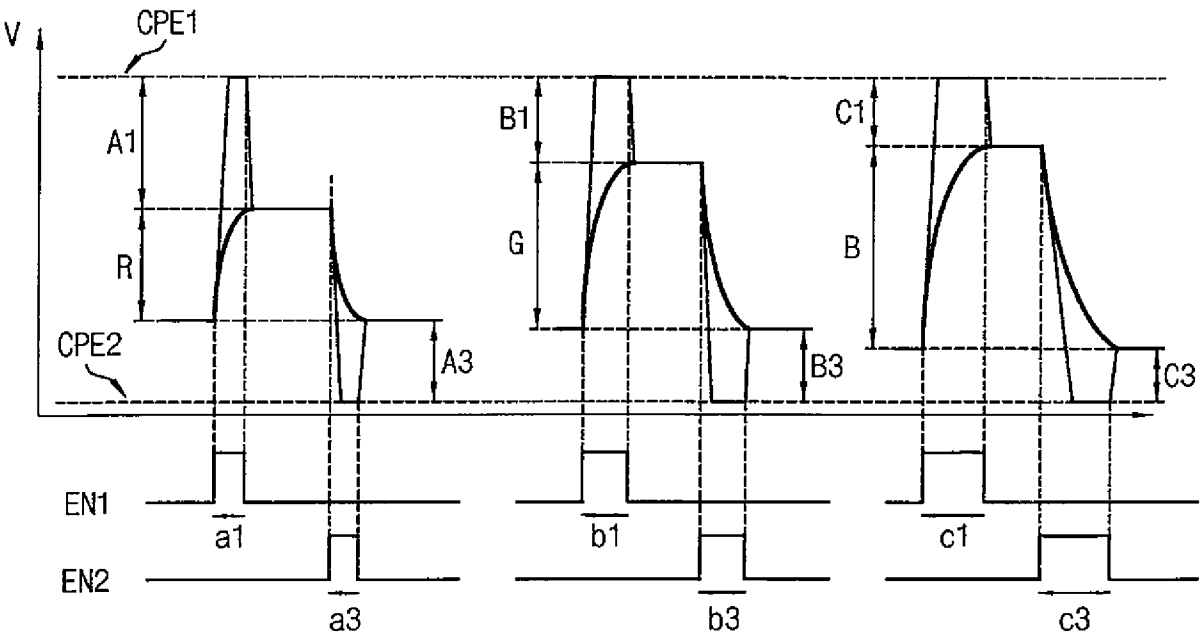
FIG. 4C is a diagram illustrating an example of pre-emphasis pulses and gamma voltages generated in the gamma voltage generator of FIG. 3.

FIG. 4C is a diagram illustrating an example of pre-emphasis pulses and gamma voltages generated in the gamma voltage generator of FIG. 3.

For example, FIG. 4C is a diagram illustrating an example of maximum swings R, G, and B of the red, green, and blue data voltages corresponding to the gamma voltages, and red, green, and blue pre-emphasis pulses corresponding to the maximum swings R, G, and B. In FIG. 4C, like reference numerals are used to designate elements of the gamma voltage generator that are the same or substantially the same as those shown in FIG. 3 and described above, and thus, detailed description of these elements may have been omitted hereafter.

Referring to FIG. 4C, the first voltage difference A1 (e.g., the voltage difference between the first common pre-emphasis voltage CPE1 and the first red gamma reference voltage) may be greater than the second voltage difference B1, and the second voltage difference B1 may be greater than the third voltage difference C1. Thus, the first activation period a1 may be shorter than the second activation period b1, and the second activation period b1 may be shorter than the third activation period c1.

The fourth voltage difference A3 (e.g., the voltage difference between the second common pre-emphasis voltage CPE2 and the nth red gamma reference voltage) may be greater than the fifth voltage difference B3, and the fifth voltage difference B3 may be greater than the sixth voltage difference C3. Thus, the fourth activation period a3 may be shorter than the fifth activation period b3, and the fifth activation period b3 may be shorter than the sixth activation period c3.

In example embodiments, the voltage levels of the red, green, and blue pre-emphasis pulses may be determined by a voltage difference between a current (e.g., present) output red, green, and blue data voltages and a previous output red, green, and blue data voltages immediately preceding the current output red, green, and blue data voltages, respectively.

As described above, when the first and second common pre-emphasis voltages CPE1 and CPE2 are served by the first and second common pre-emphasis voltage supply channels, overshooting and/or undershooting the gamma voltage may be prevented or substantially prevented by adjusting the first to sixth activation periods.

Figure 5:
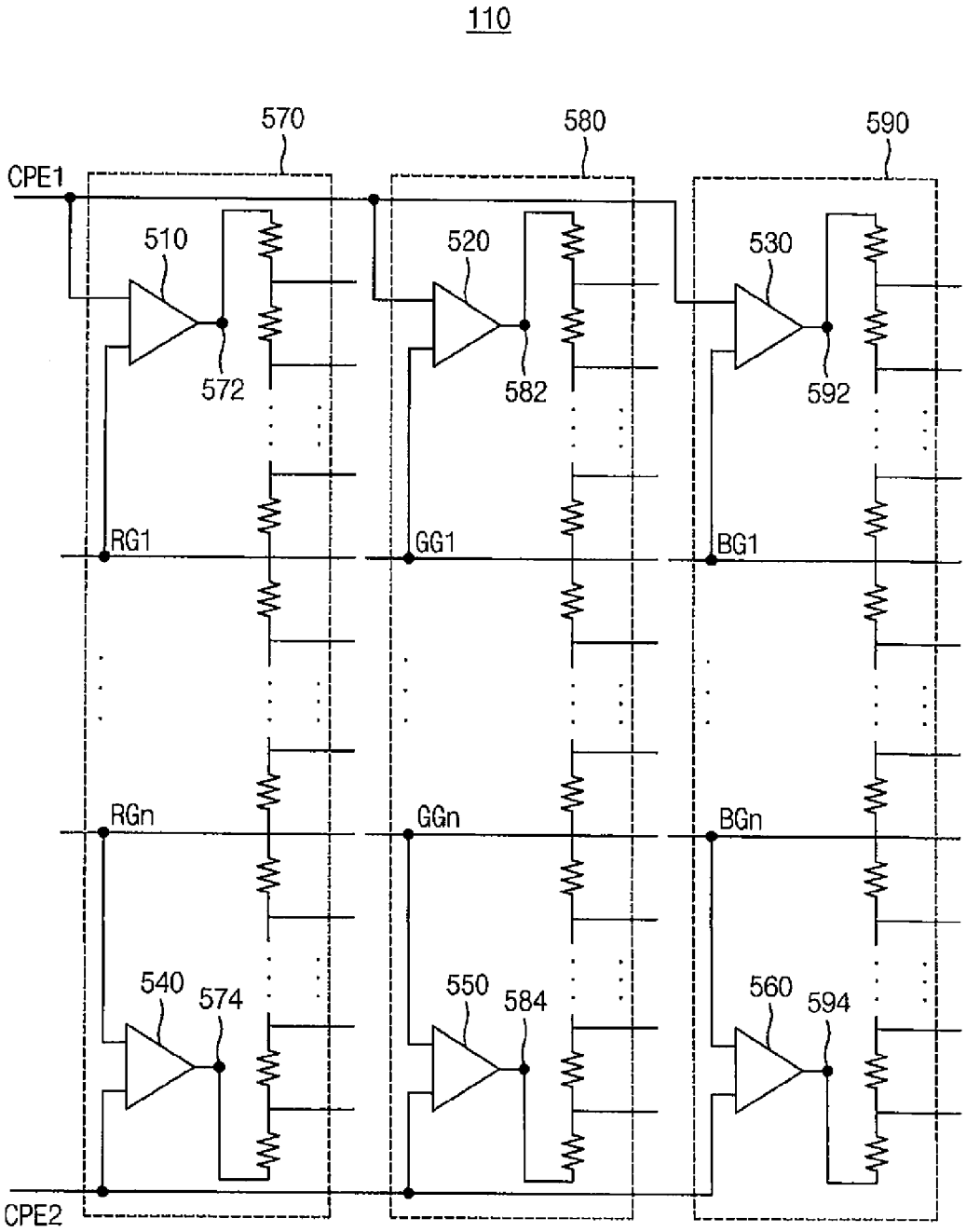
FIG. 5 is a diagram illustrating another example of a gamma voltage generator of the source driver of FIG. 1.

FIG. 5 is a diagram illustrating another example of a gamma voltage generator of the source driver of FIG. 1.

Referring to FIG. 5, the gamma voltage generator 110 may include a first resistor string 570 for generating (or determining) a plurality of red gamma voltages and a plurality of red pre-emphasis voltage levels, a second resistor string 580 for generating (or determining) a plurality of green gamma voltages and a plurality of green pre-emphasis voltage levels, and a third resistor string 590 for generating (or determining) a plurality of blue gamma voltages and a plurality of blue pre-emphasis voltage levels. The gamma voltage generator 110 may receive a first common pre-emphasis voltage CPE1 from a gamma reference voltage generator through a first common pre-emphasis voltage supply channel, and may receive a second common pre-emphasis voltage CPE2 from the gamma reference generator through a second common pre-emphasis voltage supply channel.

In example embodiments, the first common pre-emphasis voltage CPE1 is higher than a highest one of the gamma reference voltages, and the second common pre-emphasis voltage CPE2 is lower than a lowest one of the gamma reference voltages. The highest one of the gamma reference voltages may correspond to a first blue gamma reference voltage BG1, and the lowest one of the gamma reference voltages may correspond to an nth blue gamma reference voltage BGn.

In example embodiments, the gamma voltage generator 110 may include a first differential amplifier 510 coupled to a first end 572 of the first resistor string 570, a second differential amplifier 520 coupled to a first end 582 of the second resistor string 580, and a third differential amplifier 530 coupled to a first end 592 of the third resistor string 590. The first differential amplifier 510 may be configured to adjust the voltage level of one of the first red pre-emphasis pulses based on a first voltage difference between the first common pre-emphasis voltage CPE1 and the first red gamma reference voltage RG1. The second differential amplifier 520 may be configured to adjust the voltage level of one of the first green pre-emphasis pulses based on a second voltage difference between the first common pre-emphasis voltage CPE1 and the first green gamma reference voltage GG1. The third differential amplifier 530 may be configured to adjust the voltage level of one of the first blue pre-emphasis pulses based on a third voltage difference between the first common pre-emphasis voltage CPE1 and the first blue gamma reference voltage BG1. Thus, the first to third differential amplifier 510, 520, and 530 may adjust the voltage levels of the first red, first green, and first blue pre-emphasis pulses to have the voltage levels lower than the first common pre-emphasis voltage CPE1 to prevent or substantially prevent the red, green and blue gamma voltages from overshooting.

In example embodiments, the gamma voltage generator 110 may further include a fourth differential amplifier 540 coupled to a second end 574 of the first resistor string 570, a fifth differential amplifier 550 coupled to a second end 584 of the second resistor string 580, and a sixth differential amplifier 560 coupled to a second end 594 of the third resistor string 590. The fourth differential amplifier 540 may be configured to adjust the voltage level of one of the second red pre-emphasis pulses based on a fourth voltage difference between the second common pre-emphasis voltage CPE2 and the nth red gamma reference voltage RGn. The fifth differential amplifier 550 may be configured to adjust the voltage level of one of the second green pre-emphasis pulses based on a fifth voltage difference between the second common pre-emphasis voltage CPE2 and the nth green gamma reference voltage GGn. The sixth differential amplifier 560 may be configured to adjust the voltage level of one of the second blue pre-emphasis pulses based on a sixth voltage difference between the second common pre-emphasis voltage CPE2 and the nth blue gamma reference voltage BGn. Thus, the fourth to sixth differential amplifier 540, 550, and 560 may adjust the voltage levels of the second red, second green, and second blue pre-emphasis pulses to have the voltage levels higher than the second common pre-emphasis voltage CPE2 to prevent the red, green, and blue gamma voltages from undershooting.

Figure 6A:
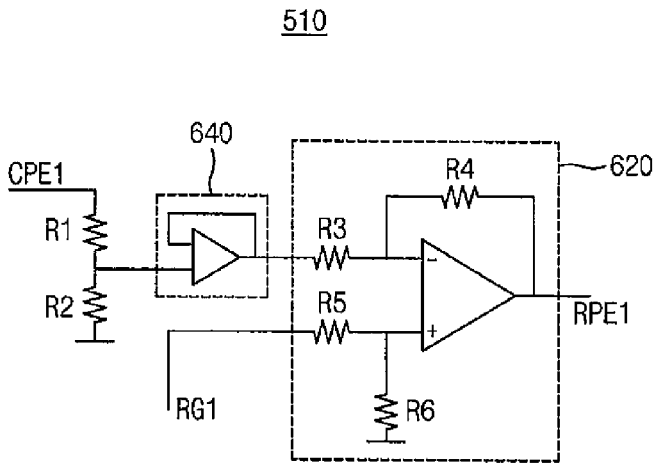
FIG. 6A is a diagram illustrating an example of a differential amplifier included in the gamma voltage generator of FIG. 5.

FIG. 6A is a diagram illustrating an example of a differential amplifier included in the gamma voltage generator of FIG. 5.

Referring to FIG. 6A, the first differential amplifier 510 may include a differential amplifier circuit 620 and a buffer 640.

The first common pre-emphasis voltage CPE1 may be inputted to a first input terminal (e.g., a negative input terminal) of the first differential amplifier 510, and the first red gamma reference voltage RG1 may be inputted to a second input terminal (e.g., a positive input terminal) of the first differential amplifier 510. The first differential amplifier 510 may determine a highest voltage level RPE1 of the first red pre-emphasis pulse by the first common pre-emphasis voltage CPE1 and the first red gamma reference voltage RG1. The highest voltage level RPE1 of the first red pre-emphasis pulse may be determined by the following equation (1).

$$RPE1 = \left(\frac{R3+R4}{R5+R6}\right)\cdot\frac{R6}{R3}\cdot RG1 - \frac{R4}{R3}\cdot\frac{R2}{R1+R2}\cdot CPE1 \qquad \text{Equation (1)}$$

The highest voltage level RPE1 of the first red pre-emphasis pulse may be proportional to the first red gamma voltage RG1. In other words, the greater the voltage difference between the first common pre-emphasis voltage CPE1 and the first red gamma reference voltage RG1, the lower the highest voltage level RPE1 of the first red pre-emphasis pulse. Second and third differential amplifiers may have substantially the same constitution as the first differential amplifier 510.

The nth red gamma reference voltage RGn may be inputted to a first input terminal (e.g., a negative input terminal) of a fourth differential amplifier, and the second common pre-emphasis voltage CPE2 may be inputted to a second input terminal (e.g., a positive input terminal) of the fourth differential amplifier. The fourth differential amplifier may determine a highest voltage level of the second red pre-emphasis pulse by the second common pre-emphasis voltage CPE2 and the nth red gamma reference voltage RGn. Thus, the greater the voltage difference between the second common pre-emphasis voltage CPE2 and the nth red gamma reference voltage, the higher the lowest voltage level of the second red pre-emphasis pulse. Fifth and sixth differential amplifiers may have substantially the same constitution as the fourth differential amplifier.

Resistances of resistors R1, R2, R3, R4, R5, and R6 included in the differential amplifiers may be adjusted, so that the first red, first green, and first blue pre-emphasis pulses may have different highest voltage levels. Similarly, the second red, second green, and second blue pre-emphasis pulses may have different lowest voltage levels.

Figure 6B:
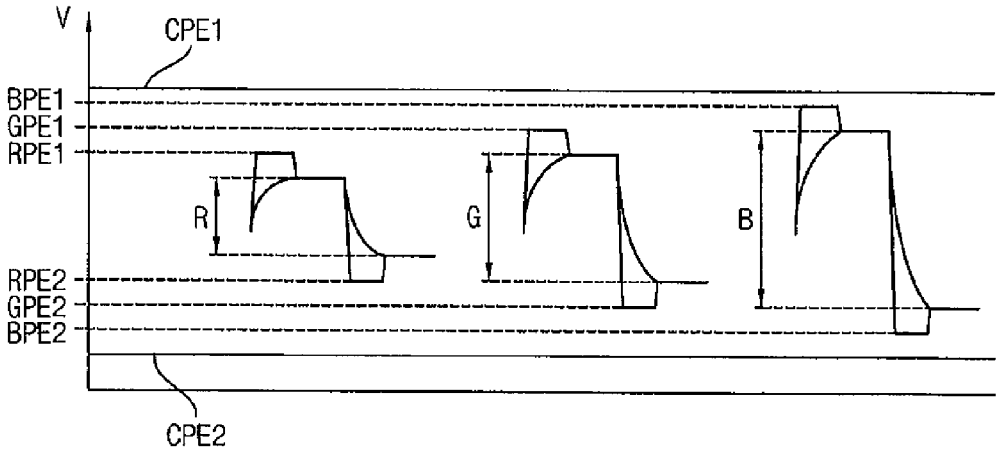
FIG. 6B is a diagram illustrating an example of pre-emphasis pulses and gamma voltages generated in the gamma voltage generator of FIG. 5.

FIG. 6B is a diagram illustrating an example of pre-emphasis pulses and gamma voltages generated in the gamma voltage generator of FIG. 5.

For example, FIG. 6B is a diagram illustrating an example of maximum swings R, G, and B of red, green, and blue data voltages corresponding to the gamma voltages, and red, green, and blue pre-emphasis pulses corresponding to the maximum swings R, G, and B.

Referring to FIG. 6B, the highest voltage level RPE1 of the first red pre-emphasis pulse generated in the first differential amplifier may be lower than the highest voltage level GPE1 of the first green pre-emphasis pulse generated in the second differential amplifier, and the highest voltage level GPE1 may be lower than the highest voltage level BPE1 of the first blue pre-emphasis pulse generated in the third differential amplifier. The lowest voltage level RPE2 of the second red pre-emphasis pulse generated in the fourth differential amplifier may be higher than the lowest voltage level GPE2 of the second green pre-emphasis pulse generated in the fifth differential amplifier, and the lowest voltage level GPE2 may be higher than the lowest voltage level BPE2 of the second blue pre-emphasis pulse generated in the sixth differential amplifier. In this case, in example embodiments, each of the activation periods of the pre-emphasis pulses (e.g., the first to sixth activation periods) may be substantially the same.

As described above, when the first and second common pre-emphasis voltages CPE1 and CPE2 are served by the first and second common pre-emphasis voltage supply channels, overshooting the gamma voltage may be prevented or substantially prevented by adjusting the voltage levels of the highest pre-emphasis pulses by the first to third differential amplifiers, and undershooting the gamma voltage may be prevented or substantially prevented by adjusting the voltage levels of the lowest pre-emphasis pulses by the fourth to sixth differential amplifiers.

Figure 7:
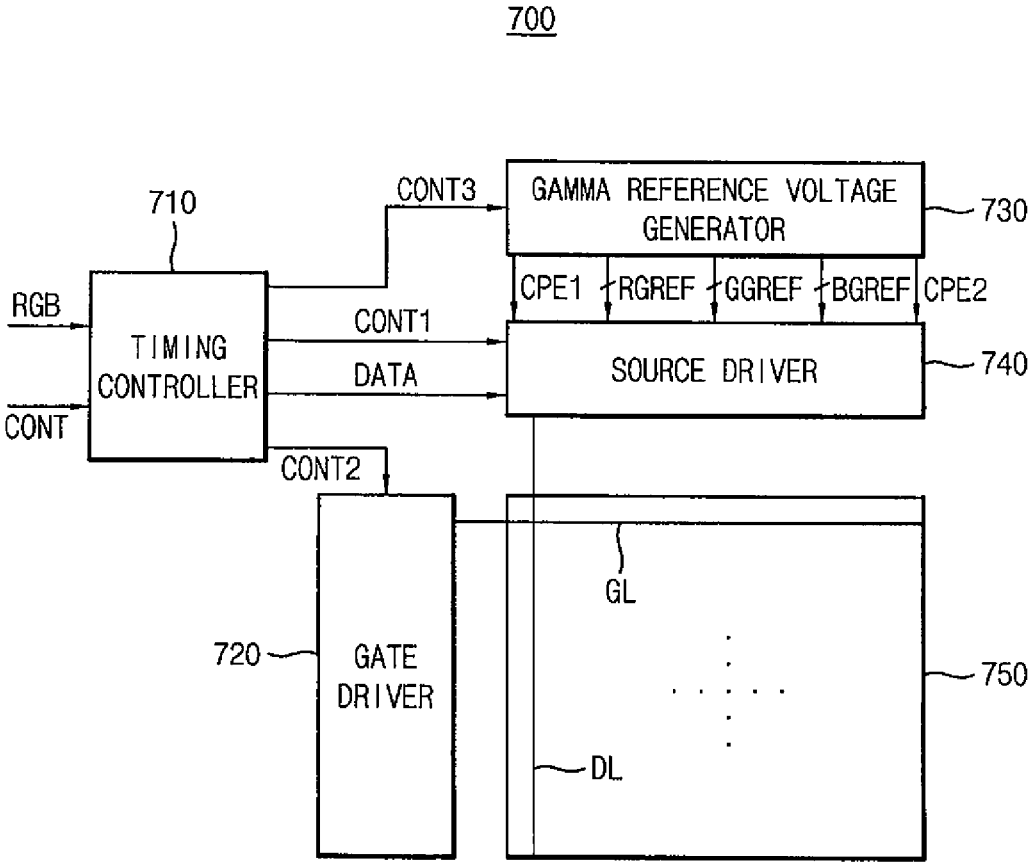
FIG. 7 is a block diagram illustrating a display device according to example embodiments.

FIG. 7 is a block diagram illustrating a display device according to example embodiments.

Referring to FIG. 7, the display device 700 may include a timing controller 710, a gate driver 720, a gamma reference voltage generator 730, a source driver 740, and a display panel 750.

The display panel 750 may include a plurality of pixels that are arranged in a matrix having a plurality of rows and a plurality of columns. In example embodiments, each pixel may include a red sub-pixel, a green sub-pixel, and a blue sub-pixel. The timing controller 710 may receive an input image date RGB and an input control signal CONT from an external device. Based on the input image date RGB and the input control signal CONT, the timing controller 710 may generate image data signal DATA provided to the source driver 740, and may generate a plurality of control signals CONT1, CONT2, and CONT3 respectively provided to the source driver 740, the gate driver 720, and the gamma reference voltage generator 730.

The gate driver 720 may provide a gate signal to the display panel 750 through a plurality of gate lines GL. The source driver 740 may provide red, green, and blue data voltages to the display panel 750 through a plurality of data lines DL (e.g., a plurality of red, green, and blue data lines).

The gamma reference voltage generator 730 may generate a plurality of gamma reference voltages according to the control signal CONT3. The gamma reference voltage generator 730 may provide the gamma reference voltages RGREF, GGREF, and BGREF, a first common pre-emphasis voltage CPE1, and a second common pre-emphasis voltage CPE2 to the source driver 740.

The gamma reference voltage generator 730 may generate first to nth red gamma reference voltages RGREF, first to nth green gamma reference voltages GGREF, and first to nth blue gamma reference voltages BGREF. Also, the gamma reference voltage generator 730 may generate first common pre-emphasis voltage CPE1 higher than a highest one of the gamma reference voltages RGREF, GGREF, and BGREF, and may generate the second common pre-emphasis voltage CPE2 lower than a lowest one of the gamma reference voltages RGREF, GGREF, and BGREF.

In example embodiments, the display device 700 may include n number of red gamma reference voltage supply channels that transfer the first to nth red gamma reference voltages RGREF from the gamma reference voltage generator 730 to the source driver 740, n number of green gamma reference voltage supply channels that transfer the first to nth green gamma reference voltages GGREF from the gamma reference voltage generator 730 to the source driver 740, and n number of blue gamma reference voltage supply channels that transfer the first to nth blue gamma reference voltages BGREF from the gamma reference voltage generator 730 to the source driver 740. The display device 700 may further include a first common pre-emphasis voltage supply channel that transfers the first common pre-emphasis voltage CPE1 from the gamma reference voltage generator 730 to the source driver 740, and a second common pre-emphasis voltage supply channel that transfers the second common pre-emphasis voltage CPE2 from the gamma reference voltage generator 730 to the source driver 740. Thus, the number of the pre-emphasis voltage supply channels may be smaller when compared to conventional pre-emphasis voltage supply channels.

Generally, a voltage range of a red gamma voltage may be greater than a voltage range of a green gamma voltage, and the voltage range of the green gamma voltage may be greater than a voltage range of a blue gamma voltage. Thus, when the first common pre-emphasis voltage CPE1 and the second common pre-emphasis voltage CPE2 are commonly provided to generate the red, green, and blue data voltages, voltage overshoot/undershoot and ringing may be unexpectedly produced in the red and green data voltages having relatively small data ranges.

Therefore, in example embodiments, the activation periods of the pre-emphasis pulses based on the first and second common pre-emphasis voltages CPE1 and CPE2 may be adjusted to prevent or substantially prevent the gamma voltages overshoot/undershoot and ringing. Since adjusting the activation periods is described above with reference to FIGS. 3 through 4C, duplicate description will not be repeated.

In example embodiments, voltage levels of the pre-emphasis pulses based on the first and second common pre-emphasis voltages CPE1 and CPE2 may be adjusted to prevent or substantially prevent the gamma voltages overshoot/undershoot and ringing. Adjusting the voltage levels may be performed using differential amplifiers. Since adjusting the voltage levels is described above with reference to FIGS. 5 through 6B, duplicate description will not be repeated.

The source driver 740 may include a gamma voltage generator and a voltage supply unit. The source driver 740 may receive the control signal CONT2 and image data signal DATA from the timing controller 710. The source driver 740 may receive the red, green, and blue gamma reference voltages RGREF, GGREF, and BGREF, and the first and second common pre-emphasis voltages CPE1 and CPE2 from the gamma reference voltage generator 730. The source driver 740 may convert the image data signal DATA to analog red, green, and blue data voltages using the red, green, and blue gamma reference voltages RGREF, GGREF, and BGREF. Also, the source driver 740 may generate the red, green, and blue pre-emphasis pulses corresponding to the red, green, and blue data voltages based on the first and second common pre-emphasis voltages CPE1 and CPE2. Since the source driver 740 is described above with reference to FIG. 1, duplicate description will not be repeated.

In example embodiments, the second common pre-emphasis voltage CPE2 may be a ground voltage. Thus, the second common pre-emphasis voltage supply channel coupled between the gamma reference voltage generator 730 and the source driver 740 may be omitted.

As described above, the source driver 740 may receive the first and second common pre-emphasis voltages CPE1 and CPE2 from the gamma reference voltage generator 730 through the first and second common pre-emphasis voltage supply channels, so that the number of the pre-emphasis voltage supply channels may decrease. Thus, production cost may be reduced, and connectors and connecting cables coupled (e.g., connected) between the gamma reference voltage generator 730 and the source driver 740 may be simplified.

In addition, the gamma voltage generator 110 may include the pre-emphasis pulse generators or the differential amplifiers, so that overshooting and/or undershooting the data voltages (e.g., the red, green, and blue gamma voltages) may be prevented or substantially prevented.

The example embodiments described herein may be applied to any source driver and to any display device including the source driver. For example, the example embodiments may be applied to a television, a digital television, a mobile phone, a smart phone, a laptop computer, a tablet computer, a personal digital assistant (PDA), a portable multimedia player (PMP), a digital camera, a music player, a portable game console, a navigation device, etc.

The foregoing is illustrative of example embodiments only, and is not to be construed as limiting thereof. Although a few example embodiments have been described, those having ordinary skill in the art will readily appreciate that various modifications are possible in the example embodiments without materially departing from the spirit and scope of the example embodiments. Accordingly, all such modifications are intended to be included within the scope of the example embodiments as defined in the claims and their equivalents. In the claims, means-plus-function clauses, if any, are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope and scope of the appended claims and their equivalents. The inventive concept is defined by the following claims, with equivalents of the claims to be included therein.

What is claimed is:

1. A source driver, comprising:

a gamma voltage generator configured:

to receive a plurality of gamma reference voltages, a first common pre-emphasis voltage, and a second common pre-emphasis voltage; and to generate a plurality of gamma voltages based on the gamma reference voltages, a plurality of first pre-emphasis pulses respectively corresponding to pixels that emit light of different colors based on the first common pre-emphasis voltage, and a plurality of second pre-emphasis pulses respectively corresponding to the pixels that emit the light of different colors based on the second common pre-emphasis voltage; and a voltage supply unit configured to output one of the first pre-emphasis pulses and the second pre-emphasis pulses to each of a plurality of data lines, and to output data voltages to the plurality of data lines based on the gamma voltages, wherein the plurality of gamma reference voltages comprises a plurality of red gamma reference voltages, a plurality of green gamma reference voltages, and a plurality of blue gamma reference voltages, wherein the plurality of gamma voltages comprises a plurality of red gamma voltages, a plurality of green gamma voltages, and a plurality of blue gamma voltages, and wherein the gamma voltage generator comprises:

a first resistor string configured to generate the red gamma voltages based on the red gamma reference voltages to determine at least one voltage level of a first one of the first pre-emphasis pulses corresponding to a red pixel based on the first common pre-emphasis voltage, and to determine at least one voltage level of a first one of the second pre-emphasis pulses corresponding to the red pixel based on the second common pre-emphasis voltage;

a second resistor string configured to generate the green gamma voltages based on the green gamma reference voltages to determine at least one voltage level of a second one of the first pre-emphasis pulses corresponding to a green pixel based on the first common pre-emphasis voltage, and to determine at least one voltage level of a second one of second pre-emphasis pulses corresponding to the green pixel based on the second common pre-emphasis voltage; and a third resistor string configured to generate the blue gamma voltages based on the blue gamma reference voltages to determine at least one voltage level of a third one of the first pre-emphasis pulses corresponding to a blue pixel based on the first common pre-emphasis voltage, and to determine at least one voltage level of a third one of the second pre-emphasis pulses corresponding to the blue pixel based on the second common pre-emphasis voltage.

2. The source driver of claim 1, wherein the gamma voltage generator is configured to receive the first common pre-emphasis voltage through a first common pre-emphasis voltage supply channel, and to receive the second common pre-emphasis voltage through a second common pre-emphasis voltage supply channel.

3. The source driver of claim 1, wherein the gamma voltage generator is further configured to adjust lengths of activation periods of the first pre-emphasis pulses based on a voltage difference between the first common pre-emphasis voltage and a highest one of the red gamma reference voltages, a voltage difference between the first common pre-emphasis voltage and a highest one of the green gamma reference voltages, and a voltage difference between the first common pre-emphasis voltage and a highest one of the blue gamma reference voltages, and wherein the gamma voltage generator is further configured to adjust lengths of activation periods of the second pre-emphasis pulses based on a voltage difference between the second common pre-emphasis voltage and a lowest one of the red gamma reference voltages, a potential voltage difference between the second common pre-emphasis voltage and a lowest one of the green gamma reference voltages, and a voltage difference between the second common pre-emphasis voltage and a lowest one of the blue gamma reference voltages.

4. The source driver of claim 1, wherein the gamma voltage generator further comprises:

a first red pre-emphasis pulse generator configured to adjust a length of a first activation period of the first one of the first pre-emphasis pulses based on a first voltage difference between the first common pre-emphasis voltage and a highest one of the red gamma reference voltages;

a first green pre-emphasis pulse generator configured to adjust a length of a second activation period of the second one of the first pre-emphasis pulses based on a second voltage difference between the first common pre-emphasis voltage and a highest one of the green gamma reference voltages; and a first blue pre-emphasis pulse generator configured to adjust a length of a third activation period of the third one of the first pre-emphasis pulses based on a third voltage difference between the first common pre-emphasis voltage and a highest one of the blue gamma reference voltages.

5. The source driver of claim 4, wherein each of the first red pre-emphasis pulse generator, the first green pre-emphasis pulse generator, and the first blue pre-emphasis pulse generator comprises:

a charging capacitor;

a charging transistor configured to charge the charging capacitor in response to an inversion signal of a gamma voltage output control signal;

a voltage controlled current source configured to generate a discharge current based on a corresponding one of the first, second, and third voltage differences to discharge the charging capacitor;

a comparator configured to compare a voltage of the charging capacitor with a reference voltage; and an AND gate configured to perform an AND operation on an output signal from the comparator and the gamma voltage output control signal to determine a corresponding one of the first, second, and third activation periods.

6. The source driver of claim 4, wherein the gamma voltage generator further comprises:

a second red pre-emphasis pulse generator configured to adjust a length of a fourth activation period of the first one of the second pre-emphasis pulses based on a fourth voltage difference between the second common pre-emphasis voltage and a lowest one of the red gamma reference voltages;

a second green pre-emphasis pulse generator configured to adjust a length of a fifth activation period of the second one of the second pre-emphasis pulses based on a fifth voltage difference between the second common pre-emphasis voltage and a lowest one of the green gamma reference voltages; and a second blue pre-emphasis pulse generator configured to adjust a length of a sixth activation period of the third one of the second pre-emphasis pulses based on a sixth voltage difference between the second common pre-emphasis voltage and a lowest one of the blue gamma reference voltages.

7. The source driver of claim 6, wherein each of the second red pre-emphasis pulse generator, the second green pre-emphasis pulse generator, and the second blue pre-emphasis pulse generator comprises:

a charging capacitor;

a charging transistor configured to charge the charging capacitor in response to an inversion signal of a gamma voltage output control signal;

a voltage controlled current source configured to generate a discharge current based on a corresponding one of the fourth, fifth, and sixth voltage differences to discharge the charging capacitor;

a comparator configured to compare a voltage of the charging capacitor with a reference voltage; and an AND gate configured to perform an AND operation on an output signal from the comparator and the gamma voltage output control signal to determine a corresponding one of the fourth, fifth, and sixth activation periods.

8. The source driver of claim 1, wherein the gamma voltage generator is further configured to adjust the voltage levels of the first pre-emphasis pulses based on a voltage difference between the first common pre-emphasis voltage and a highest one of the red gamma reference voltages, a voltage difference between the first common pre-emphasis voltage and a highest one of the green gamma reference voltages, and a voltage difference between the first common pre-emphasis voltage and a highest one of the blue gamma reference voltages, and wherein the gamma voltage generator is further configured to adjust the voltage levels of the second pre-emphasis pulses based on a voltage difference between the second common pre-emphasis voltage and a lowest one of the red gamma reference voltages, a voltage difference between the second common pre-emphasis voltage and a lowest one of the green gamma reference voltages, and a voltage difference between the second common pre-emphasis voltage and a lowest one of the blue gamma reference voltages.

9. The source driver of claim 1, wherein the gamma voltage generator further comprises:

a first differential amplifier configured to adjust the voltage level of the first one of the first pre-emphasis pulses based on a voltage difference between the first common pre-emphasis voltage and a highest one of the red gamma reference voltages, the first differential amplifier being coupled to a first end of the first resistor string;

a second differential amplifier configured to adjust the voltage level of the second one of the first pre-emphasis pulses based on a voltage difference between the first common pre-emphasis voltage and a highest one of the green gamma reference voltages, the second differential amplifier being coupled to a first end of the second resistor string; and a third differential amplifier configured to adjust the voltage level of the third one of the first pre-emphasis pulses based on a voltage difference between the first common pre-emphasis voltage and a highest one of the blue gamma reference voltages, the third differential amplifier being coupled to a first end of the third resistor string.

10. The source driver of claim 9, wherein the gamma voltage generator further comprises:

a fourth differential amplifier configured to adjust the voltage level of the first one of the second pre-emphasis pulses based on a voltage difference between the second common pre-emphasis voltage and a lowest one of the red gamma reference voltages, the fourth differential amplifier being coupled to a second end of the first resistor string;

a fifth differential amplifier configured to adjust the voltage level of the second one of the second pre-emphasis pulses based on a voltage difference between the second common pre-emphasis voltage and a lowest one of the green gamma reference voltages, the fifth differential amplifier being coupled to a second end of the second resistor string; and a sixth differential amplifier configured to adjust the voltage level of the third one of the second pre-emphasis pulses based on a voltage difference between the second common pre-emphasis voltage and a lowest one of the blue gamma reference voltages, the sixth differential amplifier being coupled to a second end of the third resistor string.

11. The source driver of claim 1, wherein the second common pre-emphasis voltage is a ground voltage.

12. A display device, comprising:

a display panel;

a gate driver configured to provide a gate signal to the display panel;

a gamma reference voltage generator configured to generate a plurality of gamma reference voltages, a first common pre-emphasis voltage higher than a highest one of the gamma reference voltages, and a second common pre-emphasis voltage lower than a lowest one of the gamma reference voltages; and a source driver configured to provide a data voltage to the display panel, the source driver comprising:

a gamma voltage generator configured:

to receive the gamma reference voltages, the first common pre-emphasis voltage, and the second common pre-emphasis voltage; and to generate a plurality of gamma voltages based on the gamma reference voltages, a plurality of first pre-emphasis pulses respectively corresponding to pixels that emit light of different colors based on the first common pre-emphasis voltage, and a plurality of second pre-emphasis pulses respectively corresponding to the pixels that emit the light of different colors based on the second common pre-emphasis voltage; and a voltage supply unit configured to output one of the first pre-emphasis pulses and the second pre-emphasis pulses to each of a plurality of data lines, and to output data voltages to the plurality of data lines based on the gamma voltages, wherein the plurality of gamma reference voltages comprises a plurality of red gamma reference voltages, a plurality of green gamma reference voltages, and a plurality of blue gamma reference voltages, wherein the plurality of gamma voltages comprises a plurality of red gamma voltages, a plurality of green gamma voltages, and a plurality of blue gamma voltages, and wherein the gamma voltage generator comprises:

a first resistor string configured to generate the red gamma voltages based on the red gamma reference voltages to determine at least one voltage level of a first one of the first pre-emphasis pulses corresponding to a red pixel based on the first common pre-emphasis voltage, and to determine at least one voltage level of a first one of the second pre-emphasis pulses corresponding to the red pixel based on the second common pre-emphasis voltage;

a second resistor string configured to generate the green gamma voltages based on the green gamma reference voltages to determine at least one voltage level of a second one of the first pre-emphasis pulses corresponding to a green pixel based on the first common pre-emphasis voltage, and to determine at least one voltage level of a second one of second pre-emphasis pulses corresponding to the green pixel based on the second common pre-emphasis voltage; and a third resistor string configured to generate the blue gamma voltages based on the blue gamma reference voltages to determine at least one voltage level of a third one of the first pre-emphasis pulses corresponding to a blue pixel based on the first common pre-emphasis voltage, and to determine at least one voltage level of a third one of the second pre-emphasis pulses corresponding to the blue pixel based on the second common pre-emphasis voltage.

13. The device of claim 12, wherein the source driver is further configured to receive the first common pre-emphasis voltage from the gamma reference voltage generator through a first common pre-emphasis voltage supply channel, and the second common pre-emphasis voltage from the gamma reference voltage generator through a second common pre-emphasis voltage supply channel.

14. The device of claim 12, wherein the gamma voltage generator is further configured to adjust lengths of activation periods of the first pre-emphasis pulses based on a voltage difference between the first common pre-emphasis voltage and a highest one of the red gamma reference voltages, a voltage difference between the first common pre-emphasis voltage and a highest one of the green gamma reference voltages, and a voltage difference between the first common pre-emphasis voltage and a highest one of the blue gamma reference voltages, and wherein the gamma voltage generator is further configured to adjust lengths of activation periods of the second pre-emphasis pulses based on a voltage difference between the second common pre-emphasis voltage and a lowest one of the red gamma reference voltages, a potential voltage difference between the second common pre-emphasis voltage and a lowest one of the green gamma reference voltages, and a voltage difference between the second common pre-emphasis voltage and a lowest one of the blue gamma reference voltages.

15. The device of claim 12, wherein the gamma voltage generator further comprises:

a first red pre-emphasis pulse generator configured to adjust a length of a first activation period of the first one of the first pre-emphasis pulses based on a first voltage difference between the first common pre-emphasis voltage and a highest one of the red gamma reference voltages;

a first green pre-emphasis pulse generator configured to adjust a length of a second activation period of the second one of the first pre-emphasis pulses based on a second voltage difference between the first common pre-emphasis voltage and a highest one of the green gamma reference voltages; and a first blue pre-emphasis pulse generator configured to adjust a length of a third activation period of the third one of the first pre-emphasis pulses based on a third voltage difference between the first common pre-emphasis voltage and a highest one of the blue gamma reference voltages.

16. The device of claim 15, wherein each of the first red pre-emphasis pulse generator, the first green pre-emphasis pulse generator, and the first blue pre-emphasis pulse generator comprises:

a charging capacitor;

a charging transistor configured to charge the charging capacitor in response to an inversion signal of a gamma voltage output control signal;

a voltage controlled current source configured to generate a discharge current based on a corresponding one of the first, second, and third voltage differences to discharge the charging capacitor;

a comparator configured to compare a voltage of the charging capacitor with a reference voltage; and an AND gate configured to perform an AND operation on an output signal from the comparator and the gamma voltage output control signal to determine a corresponding one of the first, second, and third activation periods.

17. The device of claim 15, wherein the gamma voltage generator further comprises:

a second red pre-emphasis pulse generator configured to adjust a length of a fourth activation period of the first one of the second pre-emphasis pulses based on a fourth voltage difference between the second common pre-emphasis voltage and a lowest one of the red gamma reference voltages;

a second green pre-emphasis pulse generator configured to adjust a length of a fifth activation period of the second one of the second pre-emphasis pulses based on a fifth voltage difference between the second common pre-emphasis voltage and a lowest one of the green gamma reference voltages; and a second blue pre-emphasis pulse generator configured to adjust a length of a sixth activation period of the third one of the second pre-emphasis pulses based on a sixth voltage difference between the second common pre-emphasis voltage and a lowest one of the blue gamma reference voltages.

18. The device of claim 17, wherein each of the second red pre-emphasis pulse generator, the second green pre-emphasis pulse generator and the second blue pre-emphasis pulse generator comprises:

a charging capacitor;

a charging transistor configured to charge the charging capacitor in response to an inversion signal of a gamma voltage output control signal;

a voltage controlled current source configured generate a discharge current based on a corresponding one of the fourth, fifth, and sixth voltage differences to discharge the charging capacitor;

a comparator configured to compare a voltage of the charging capacitor with a reference voltage; and an AND gate configured to perform an AND operation on an output signal from the comparator and the gamma voltage output control signal to determine a corresponding one of the fourth, fifth, and sixth activation periods.

* * * * *